US007640689B2

(12) United States Patent
Fluhr

(10) Patent No.: US 7,640,689 B2
(45) Date of Patent: Jan. 5, 2010

(54) HAND GUARD SYSTEM FOR USE WITH A FIREARM

(75) Inventor: Norbert Fluhr, Oberndorf (DE)

(73) Assignee: Heckler & Koch GmbH, Obrendork/Neckar (DE)

( * ) Notice: Subject to any disclaimer, the term of this patent is extended or adjusted under 35 U.S.C. 154(b) by 0 days.

(21) Appl. No.: 12/121,516

(22) Filed: May 15, 2008

(65) Prior Publication Data

US 2009/0013579 A1 Jan. 15, 2009

Related U.S. Application Data

(63) Continuation of application No. PCT/EP2006/010965, filed on Nov. 15, 2006.

(30) Foreign Application Priority Data

Nov. 17, 2005 (DE) ..... 10 2005 054 917

(51) Int. Cl.
*F41A 3/88* (2006.01)

(52) U.S. Cl. ..... 42/75.01; 42/72

(58) Field of Classification Search ..... 42/73, 42/71.01, 75.02, 72, 75.03, 76.01; 89/14.1
See application file for complete search history.

(56) References Cited

U.S. PATENT DOCUMENTS 3,075,314 A 1/1963 Bakker (Continued)

OTHER PUBLICATIONS

Patent Cooperation Treaty, "International Search Report," issued by the International Searching Authority in connection with international counterpart PCT application No. PCT/EP2006/010965, mailed Apr. 23, 2007, 6 pages.

(Continued)

*Primary Examiner*—Michael Carone
*Assistant Examiner*—Reginald Tillman, Jr.
(74) *Attorney, Agent, or Firm*—Hanley, Flight & Zimmerman, LLC

(57) ABSTRACT

A hand guard system for use with a firearm is described. A holding unit for releasably coupling the hand guard system to a firearm includes a coupling element having an opening, a flange, and at least one coupling portion. The flange and the coupling portion form the opening so that the coupling element is slidably removable about the barrel of the firearm, and an inner surface of the coupling portion engages an outer surface of the barrel nut. The holding unit further includes a sleeve operatively coupled to the coupling element having an inner surface defining an opening so that the sleeve is slidably removable about the barrel of the firearm and the inner surface forms a shoulder and defines a groove distally located from the shoulder and sized to receive a snap ring. The snap ring retains the sleeve to the coupling element such that the shoulder and snap ring are located on opposite sides of the flange of the coupling element. The holding unit further includes a biasing member disposed between the flange and the shoulder of the sleeve to bias the sleeve away from the flange along a longitudinal axis of the barrel. The biasing member enables the sleeve to move between a first position and a second position relative to the coupling element.

22 Claims, 4 Drawing Sheets

U.S. PATENT DOCUMENTS

| | | | | | |
|---|---|---|---|---|---|
| 3,090,150 | A | * | 5/1963 | Stoner | 42/71.01 |
| 4,536,982 | A | * | 8/1985 | Bredbury et al. | 42/71.01 |
| 4,663,875 | A | | 5/1987 | Tatro | |
| 4,765,224 | A | | 8/1988 | Morris | |
| 5,010,676 | A | * | 4/1991 | Kennedy | 42/71.01 |
| 5,198,600 | A | * | 3/1993 | E'Nama | 42/90 |
| 5,826,363 | A | * | 10/1998 | Olson | 42/75.01 |
| 6,671,990 | B1 | | 1/2004 | Booth | |
| 6,694,660 | B1 | * | 2/2004 | Davies | 42/75.01 |
| 7,523,580 | B1 | * | 4/2009 | Tankersley | 42/71.01 |

OTHER PUBLICATIONS

Patent Cooperation Treaty, "Written Opinion of the International Searching Authority," issued by the International Searching Authority in connection with international counterpart PCT application No. PCT/EP2006/010965, mailed Apr. 23, 2007, 9 pages.

Patent Cooperation Treaty, "International Preliminary Report on Patentability," issued by the International Bureau on Jul. 8, 2008, in connection with a counterpart international application No. PCT/PCT/EP2006/010965 (11 pages).

* cited by examiner

HAND GUARD SYSTEM FOR USE WITH A FIREARM

RELATED APPLICATIONS

This patent is a continuation of International Patent Application Ser. No. PCT/EP2006/010965, filed Nov. 15, 2006, which claims priority to German Patent Application 10 2005 054 917.9, filed Nov. 17, 2005, both of which are hereby incorporated herein by reference in their entireties.

FIELD OF THE DISCLOSURE

This disclosure relates generally to firearms, and, more particularly, to a hand guard system for use with a firearm.

BACKGROUND

Assault rifles typically include one or more (usually two) hand guard shells that at least partially surround a barrel to provide a comfortable grip and/or to provide protection from heat during firing. In such hand guard systems, supports or holding units at both a base end and a muzzle end of the barrel removably couple the hand guard shells to the firearm. The removable hand guard shells make it possible, for example, in the case of gas-operated firearms, to route or install a throttle control rod or a gas line that is coupled to a gas bleed port adjacent the muzzle end of the barrel into a housing or receiver adjacent the base end of the barrel. Such hand guard arrangements are typically employed, for example, in the M16 family of firearms.

Modern firearm systems increasingly demand additional component carriers (e.g., scopes, sights, etc.) to be mounted to the firearm above suitable coupling profiles such as, for example, a coupling profile of a Picatinny rail. In particular, for sighting or aiming components, it is often necessary to couple a component carrier to the barrel region of the firearm, if at all possible, without supporting the carrier on the barrel. In these instances, the holding units are typically removed and the component carriers are mounted to the firearm. In typical hand guard systems, however, the barrel must be removed in order to remove the holding unit, thereby limiting the flexibility of the rifle.

Thus, conventional hand guard systems often times limit the flexibility of a firearm because the use of a component carrier (e.g., a Picatinny rail, etc.) is only possible if the barrel is disassembled and the hand guard system, including the holding units, are replaced by the component carrier. This is particularly disadvantageous for firearms in which a sighting device is coupled to the barrel because removal of the barrel may require readjustment and/or recalibration of the sighting device. Additionally and/or alternatively, removal and reattachment of a barrel may be expensive and may require professional installation expertise.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity. Further, throughout this description, position designations such as "front," "behind," "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the firearm is always assumed, i.e., the position in which the barrel runs along a horizontal axis.

In general, the example hand guard system described herein is removably coupled to a firearm such as, for example, an M16 rifle, etc. In particular, the example hand guard system described herein comprises a first support or holding unit and a second support or holding unit, each of which removably couples to a firearm to support a hand guard shell therebetween without having to remove or disassemble a barrel of the firearm to remove the holding units. The first holding unit includes a biasing element, for example, a spring, that enables the first holding unit to be positioned between a first position, in which the first holding unit supports the shell around the barrel, and a second position, in which the first holding unit releases the shell from around the barrel when the shell is to be removed from the firearm.

In this manner, the example hand guard system can be replaced with a component carrier such as, for example, a Picatinny rail, without having to disassemble the firearm and, in particular, without having to remove or disassemble the barrel. This is particularly advantageous when a sighting device is coupled to the barrel, which may otherwise require readjustment and/or recalibration of the sighting device each time the barrel is removed and reattached to the firearm. The component carrier may be employed for the attachment of various accessories such as, for example, sights, scopes, etc. Additionally and/or alternatively, the example hand guard system described herein can eliminate or substantially reduce installation costs associated with disassembly and reattachment of the barrel.

Figure 1:
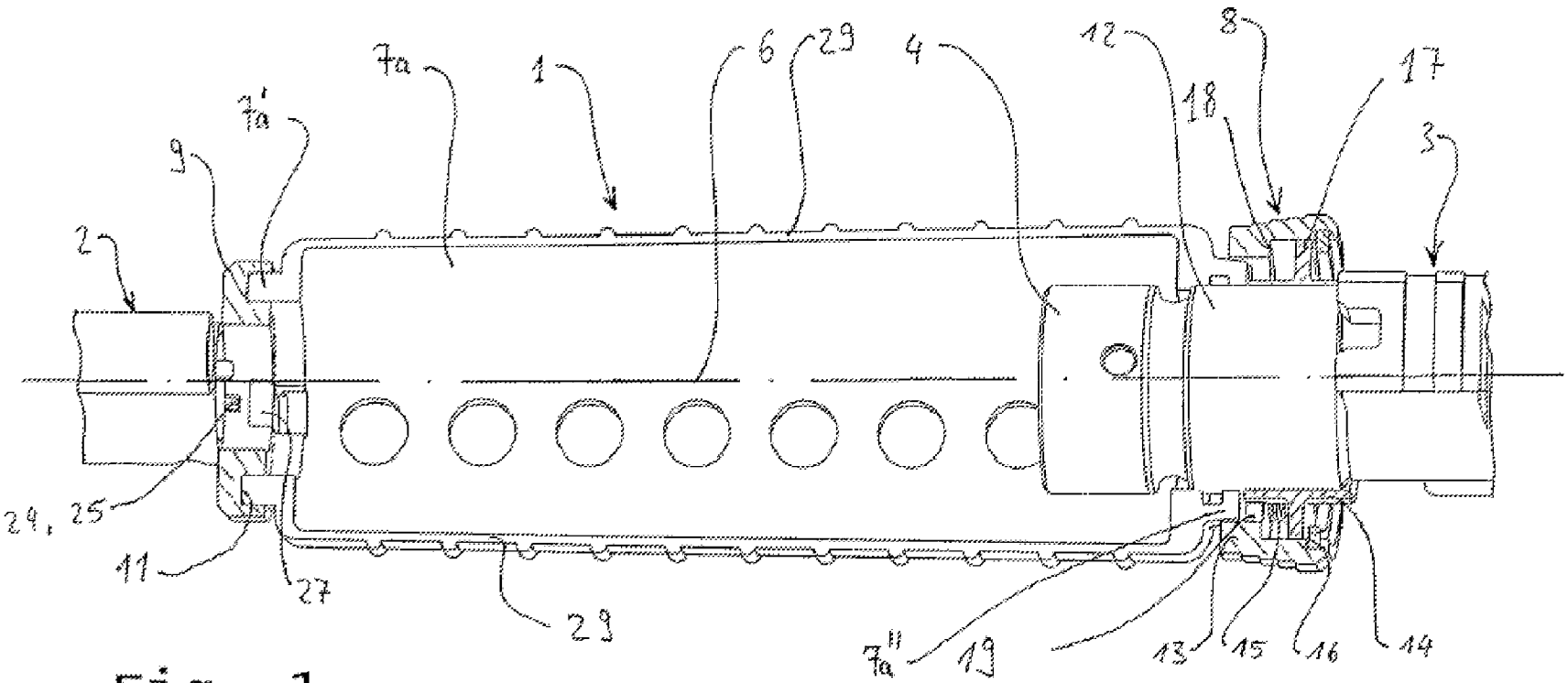
FIG. 1 is a partial cross-sectional side view of a hand guard region of a firearm showing example holding units.
Figure 2:
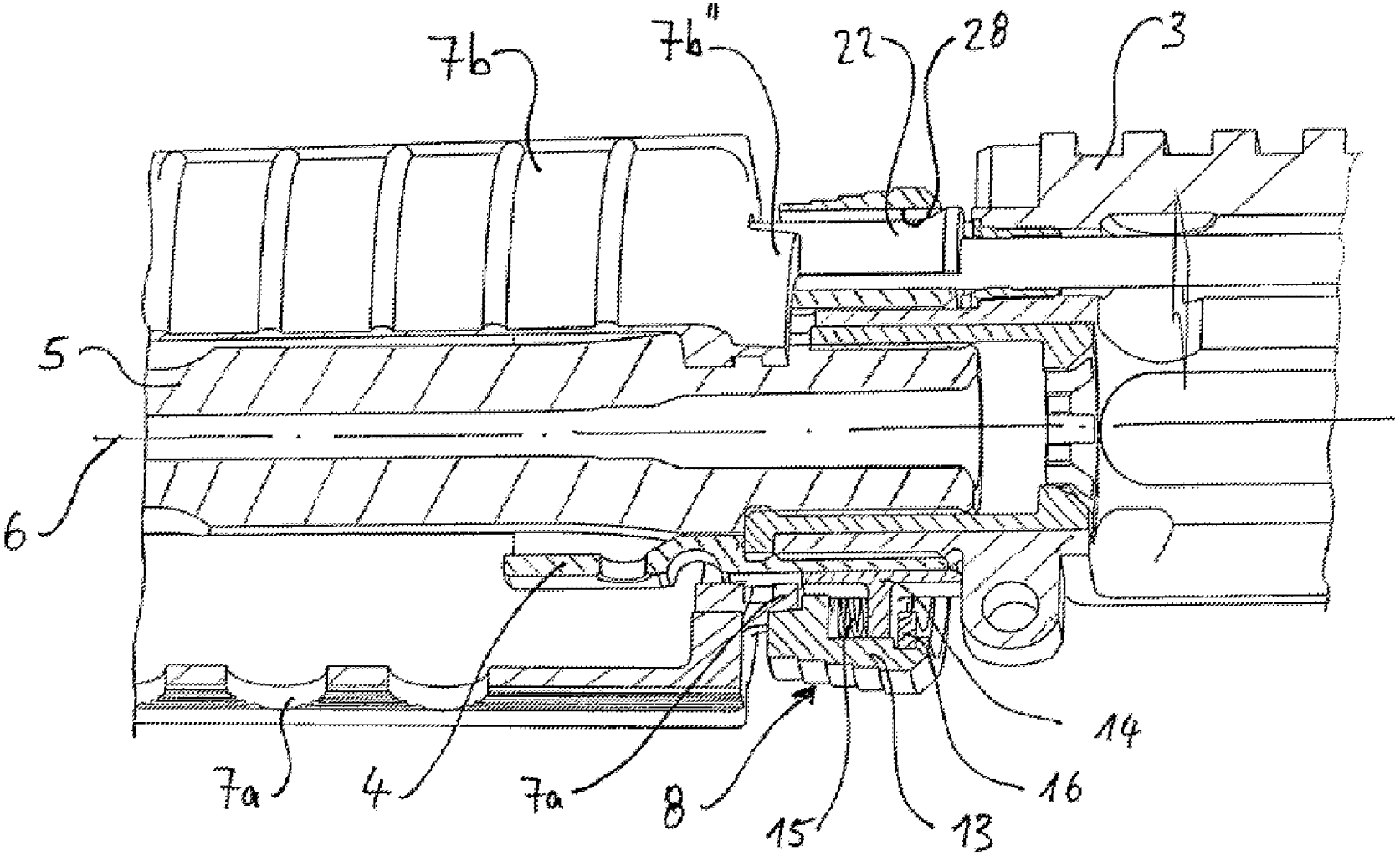
FIG. 2 is an enlarged partial cross-sectional view of the example firearm of FIG. 1 showing the base end of the barrel.

FIGS. 1 and 2 illustrate an example firearm 1 implemented with an example hand guard system described herein. Specifically, FIG. 1 illustrates a portion of the firearm 1 that extends from a gas bleed port 2 to a housing or receiver portion 3 of the firearm 1. The gas bleed port 2 and the housing 3 are only partially shown. Referring to FIGS. 1 and 2, a barrel nut 4 couples a barrel 5 (see FIG. 2) to the housing 3 at a base end of the barrel 5. The barrel 5 extends from the base end of the barrel 5 to a muzzle end and defines an axis 6. Upper and lower hand guard shells 7*a*, 7*b* are releasably coupled to the firearm 1 about the axis 6 of the barrel 5 via a first support or holding unit 8 and a second support or holding unit 9. For example, the holding unit 8 includes a sleeve 13 and the holding unit 9 includes a groove 11, each of which slidably receives a respective end 7*a*', 7*b*', 7*a*", 7*b*" to support the upper and/or the lower hand guard shell elements 7*a*, 7*b*.

In particular, the holding unit 8 is a generally cylindrical member that engages a mounting surface at the base end of the barrel 5. The mounting surface may include at least one of an outer surface of the barrel 5, the barrel nut 4, the housing 3, and/or any other suitable mounting surface on the firearm. In the illustrated example, the holding unit 8 is coupled to an outer surface 12 of the barrel nut 4. The holding unit 8 includes a sleeve 13, a coupling element 14, and a biasing element 15. The biasing element 15 is disposed between the sleeve 13 and the coupling element 14. The sleeve 13 includes a groove to receive a snap ring 16 that retains the sleeve 13 to the coupling element 14. In this example, the biasing element 15 includes a plurality of springs (e.g., compression springs) disposed generally uniformly around a periphery of the coupling element 14 and the sleeve 13. Specifically, the springs are disposed between a flange 17 of the coupling element 14 and a support shoulder 18 formed at an inner surface of the sleeve 13.

A holding collar 19 is disposed between the shoulder 18 of the holding sleeve 13 and the coupling element 14. The shoulder 18 of the sleeve 13 and the holding collar 19 engage the ends 7*a*", 7*b*" to support the upper and lower shell elements 7*a*, 7*b*, respectively. In the illustrated example, the body of the upper and lower shell elements 7*a*, 7*b*, when coupled together, form a frustoconical or tapered surface. When the holding collar 19 engages the ends 7*a*", 7*b*", the holding collar 19 provides a radial force to the upper and lower shells 7*a*, 7*b* in a direction that is away from the outer surface 12 of the barrel nut 4 and an axial force to the upper and lower shells 7*a*, 7*b* in a direction of the axis 6 toward the holding unit 9 to bias or move the ends 7*a*', 7*b*' toward and/or within the groove 11 of the holding unit 9. The upper shell 7*a* and lower shell 7*b* are thereby retained between the holding units 8, 9. Additionally and/or alternatively, the frustoconical shape provides a wedge effect when the shells 7*a*, 7*b* are coupled to the first and second holding units 8, 9 to substantially reduce or eliminate firearm backlash or recoil imported to the shells 7*a*, 7*b* caused during firing of the firearm.

Figure 3:
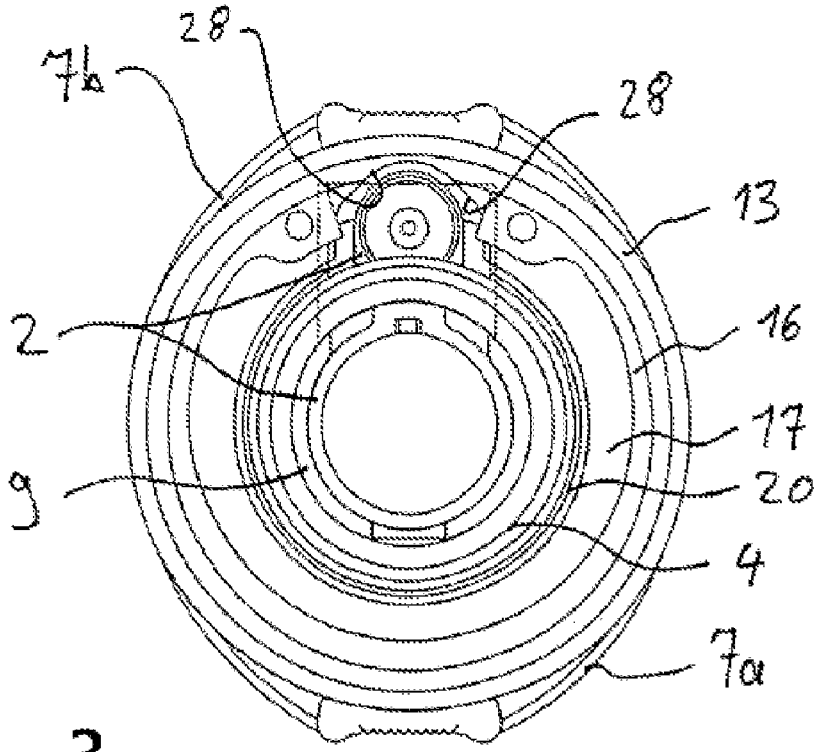
FIG. 3 is a cross-sectional view of an example spring-loaded base end holding unit of the example hand guard assembly of FIGS. 1 and 2.

Referring also to FIG. 3, the sleeve 13 includes a recess 28 sized so that the sleeve 13 can be slidably removed from the firearm 1 via the muzzle end of the barrel 5. Additionally or alternatively, the recess 28 enables the sleeve 13 to be slidably removed along an operating element such as, for example a gas tube 22, and over the gas bleed port 2 and/or sighting device. In the example, the gas tube 22 extracts gas from barrel 5 after firing and redirects it back to an operating mechanism in the housing 3. However, in other example implementations, the operating element may include a gas cylinder and/or any other mechanism(s) used to cycle the firearm (e.g., ejecting a fired cartridge and inserting a new cartridge). The snap ring 16 is a clasp-like structure also having a space or gap aligned with the recess 28 to allow the gas tube 22 to pass therethrough and to enable the snap ring 16 to be slidably removable from the firearm 1 via the muzzle end of the barrel 5 along the gas tube 22 and over the gas bleed port 2 and/or a sighting device. In this manner, the holding unit 8 removes from the firearm 1 without having to disassemble or remove the barrel 5 and/or the barrel nut 4.

In the illustrated example, the outer surface of the sleeve 13 includes a plurality of stepped shoulders to form a gripping surface. In other example implementations, other surface configurations such as, for example, knurls, recessed grips, grip inserts, grip zones made of particularly easy to grip materials, etc., may be used to provide a grip to facilitate operation of the sleeve 13.

Figure 6:
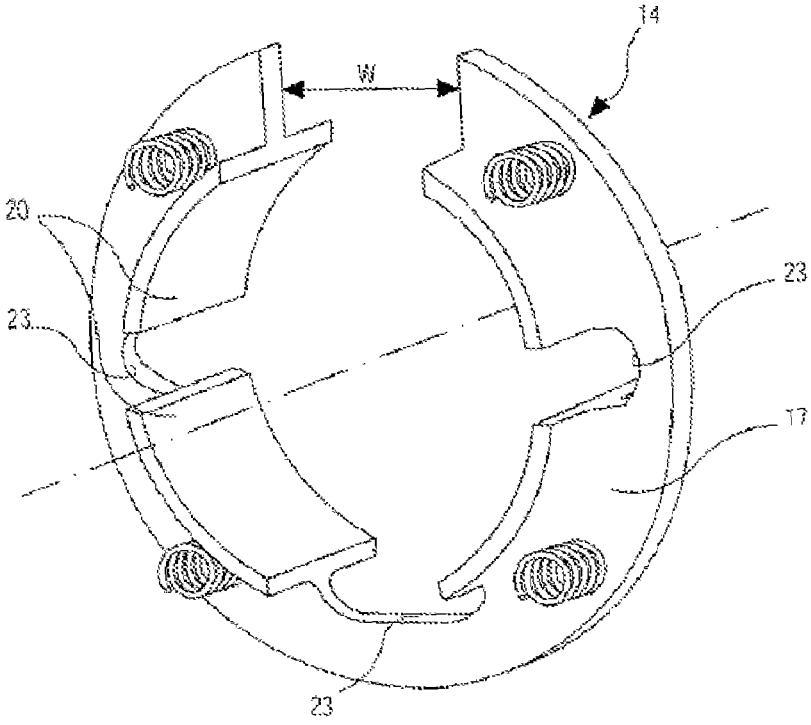
FIG. 6 is a front perspective view of an example coupling element of the example spring-loaded base end holding unit of FIGS. 1 and 2.

As most clearly shown in FIG. 6, the example coupling element 14 is a clasp-like structure that includes sleeve or coupling portions 20. The coupling portions 20 are partial cylindrical sleeve portions or segments adjacent (e.g., substantially perpendicular) to the flange 17. The coupling portions 20 engage the outer surface 12 of the barrel nut 4, which also has a cylindrical outer surface. The coupling portions 20 form an opening having an inner diameter and an inner surface that is sized to be slidably received about the barrel 5. The coupling portions 20 engage the outer surface 12 of the barrel nut 4 to couple or mount the coupling element 14 to the barrel nut 4. Additionally, the coupling element 14 is slipped or slidably received about the barrel 5 and the barrel nut 4 and frictionally engages the outer surface 12 of the barrel nut 4.

The coupling element 14 includes a space or passage W to allow an operating element such as, for example, the gas tube 22 to pass therethrough and to enable the coupling element 14 to be coupled to and/or removed from the firearm 1 radially about the barrel 5. Additionally, the space W enables the coupling element 14 to be coupled to and/or removed from the firearm 1 radially by slipping it around and/or pulling it away from the mounting surface of the barrel nut 4. The coupling element 14 also included recess portions 23 to allow the coupling portions 20 to flex radially outward and to enable the coupling element 14 to be slipped over the barrel nut 4, to frictionally engage the outer surface 12 of the barrel nut 4. In this example, the coupling element 14 has a slightly smaller diameter opening than that of the outer surface of the barrel nut 4 to provide a greater frictional engagement.

Figure 4:
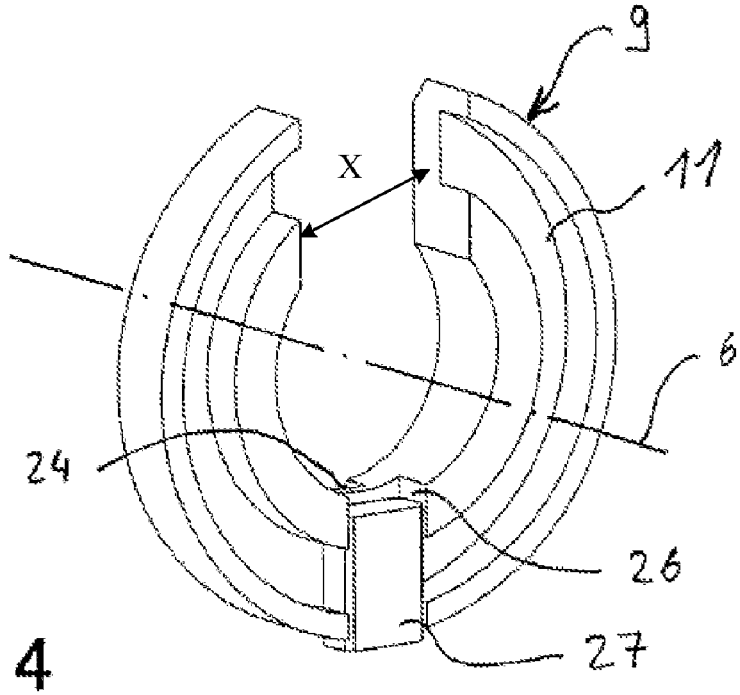
FIG. 4 is a rear perspective view of an example muzzle end holding unit of the example hand guard assembly of FIGS. 1 and 2.
Figure 5:
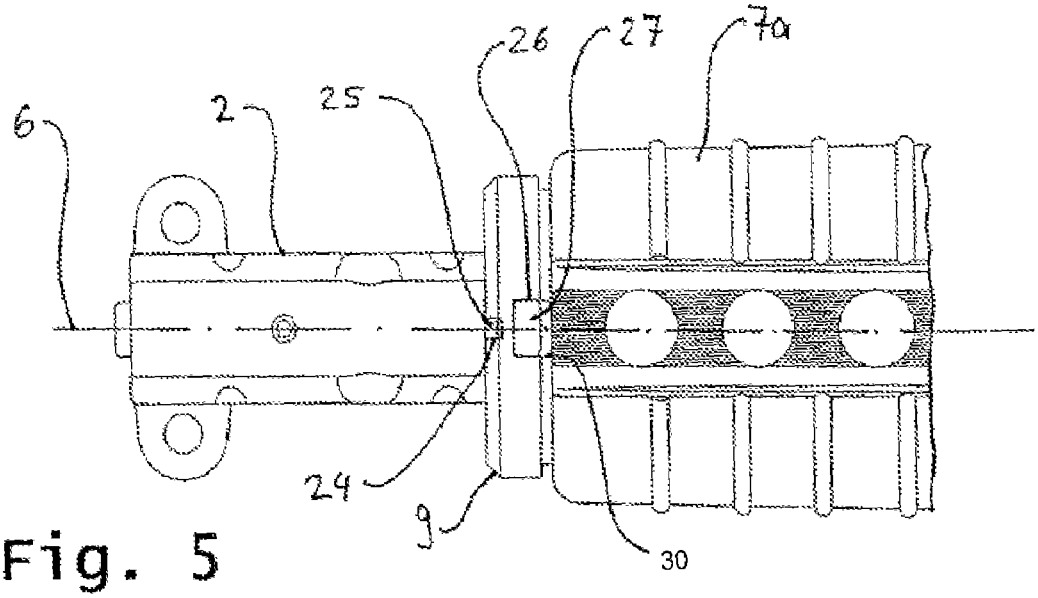
FIG. 5 is partial bottom side view of the muzzle end of the example firearm of FIGS. 1 and 2.

Referring to FIGS. 4 and 5, the second holding unit 9 couples to a second mounting surface of the firearm at a distal end from the first holding unit 8. In this example, the second holding unit 9 is a generally cylindrical clasp-like structure that couples or engages a mounting surface adjacent the muzzle end of the barrel 5 between the gas bleed port 2 and the lower shell element 7*a*. The mounting surface may be an outer surface of the barrel 5, the gas bleed port 2, sighting device, etc. In the illustrated example, the holding unit 9 includes a radial groove 24 on a first side that engages a protruding member 25 of the gas bleed port 2 to axially align (i.e., center) the holding unit 9 relative to the axis 6 of the barrel 5. The holding unit 9 also includes a groove 26 adjacent to the groove 11 to receive a spring 27 that engages a corresponding groove 30 at the end 7*a*' of the lower shell element 7*a*, thereby supporting and retaining the shell element 7*a*.

The example second holding unit 9 includes a space or passage X to allow the gas bleed port 2 and/or a sighting device to pass therethrough when the second holding unit 9 is coupled to the firearm 1. Additionally, the passage X enables the second holding unit 9 to be coupled to and removed from the barrel either radially (e.g., by slipping it around the barrels) or axially (e.g., by sliding it along the axis 6 of the barrel 5) without having to disassemble or remove the barrel 5 and/or the gas bleed port 2 and/or a sighting device.

As discussed above, the hand guard system enables the hand guards 7*a*, 7*b* to be removed and coupled to the firearm 1 without having to disassemble the barrel 5. For example, to remove the shell elements 7*a*, 7*b* from the firearm, the sleeve 13 of the holding unit 8 is positioned to the second position by moving or sliding the sleeve 13 of the holding unit 8 against the force of the springs 15 in a direction along the axis 6 toward the housing 3. When the shoulder 18 of the sleeve 13 is displaced beyond the holding collar 19, the ends 7*a*", 7*b*" of the shells 7*a*, 7*b* are released and the upper and lower shells 7*a*, 7*b* pivot away from the barrel 5 to release the ends 7*a*', 7*b*' from the groove 11 of the holding unit 9.

With the release of the hand guard shell 7*a*, 7*b*, the holding unit 9 may be removed from the muzzle end of the barrel 5. In particular, the opening of the example holding unit 9 is sized so that the holding unit 9 can be slipped over the barrel 5. In some examples, the barrel may have a frustoconical shape, which facilitates removal of the holding unit 9. In other examples, the holding unit 9 may be removed radially by expanding or flexing the holding unit 9 outwardly so that the holding unit 9 can be slipped over the barrel 5, the gas bleed port 2 and/or a sighting device at the muzzle end of the barrel 5.

To remove the holding unit 8, the holding unit 8 may be removed by sliding it from the barrel nut 4 and moving toward to the muzzle end of the barrel 5. There, the holding unit 8 flexes or expands so that it slides over the gas bleed port 2 and/or any other obstacle. After the holding unit 8 is removed, a component carrier (not shown) or other hand guard (not shown) may be coupled to the firearm 1, to the barrel 5, and/or to the barrel nut 4.

In some examples, the coupling element 14 of the holding unit 8 must be flexed or expanded when removed from the mounting surface such as, for example, the surface 12 of the barrel nut 4. In this example, the snap ring 16 is removed from the holding sleeve 13 so that the holding sleeve 13 may be removed from the barrel nut 4 by sliding the sleeve 13 from the base end of the barrel 5 toward the muzzle end of the barrel 5 prior to removal of the coupling element 14. The coupling element 14 is then expanded or flexed outwardly with, for example, a corresponding tool (not shown) to release the coupling portions 20 from the outer surface 12 of the barrel nut 4. The coupling element 14 is then slidably removed via the muzzle end of the barrel 5. In other examples, the width W of the coupling element 14 may be sized so as to enable it to be radially removed from the barrel nut 4 such as, for example, by slipping the coupling element 14 off the surface 12 of the barrel nut 4.

In another example, the width W of the space of the coupling element 14 and the width of the snap ring 16 are sized to correspond to an outer diameter of the barrel 5 so that the coupling element 14 and the snap ring 16 slidably remove about the barrel 5 between the barrel nut 4 and the gas bleed port 2 and/or sighting device.

In yet another example, the coupling element 14 is coupled to the barrel nut 4 via a non-frictional engagement and is aligned circumferentially about the barrel 5 when the shell elements 7*a*, 7*b* are coupled to the holding units 8 and 9. In this example, the holding unit 9 is circumferentially aligned about the axis 6 when coupled or supported by the gas bleed port 2 and the holding unit 8 is circumferentially aligned about the axis 6 when coupled or supported by the housing 3.

Furthermore, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A holding unit for releasably coupling a hand guard system to a firearm having a barrel secured to the firearm by a barrel nut, comprising:

a coupling element having an opening, a coupling portion, and a flange, wherein the flange and the coupling portion define the opening so that the coupling element is slidably removable about the barrel of the firearm, and wherein an inner surface of the coupling portion engages an outer surface of the barrel nut;

a sleeve operatively coupled to the coupling element having an inner surface defining an opening so that the sleeve is slidably removable about the barrel of the firearm, and wherein the inner surface forms a shoulder and defines a groove distally located from the shoulder and sized to receive a snap ring, wherein the snap ring retains the sleeve to the coupling element such that the shoulder and snap ring are located on opposite sides of the flange of the coupling element; and a biasing member disposed between the flange and the shoulder of the sleeve to bias the sleeve away from the flange along a longitudinal axis of the barrel, wherein the biasing member enables the sleeve to move between a first position and a second position relative to the coupling element.

2. A holding unit as defined in claim 1, wherein at least a portion of the interior surface of the sleeve engages an end of the hand guard system to secure the hand guard system to the firearm.

3. A holding unit as defined in claim 1, further comprising a holding collar adjacent the shoulder, wherein the holding collar engages an end of a hand guard system to secure the hand guard system to the firearm.

4. A holding unit as described in claim 1, wherein the biasing member comprises a plurality of springs radially disposed about the circumference of the flange.

5. A holding unit as described in claim 1, wherein the coupling element further comprises a space to receive an operating element therethrough, and wherein the space enables the coupling element to be radially coupled to the outer surface of the barrel nut.

6. A holding unit as described in claim 1, wherein the coupling element further comprises at least one recess portion at an inner surface of the flange to enable the coupling element to radially flex when the coupling element is coupled to the barrel nut.

7. A holding unit as described in claim 1, wherein the holding unit removably couples to the firearm without having to remove the barrel or the barrel nut from the firearm.

8. A firearm, comprising:

a housing;

a barrel operatively coupled to the housing by a barrel nut;

a first support member removably coupled to a first mounting surface of the firearm, wherein the first support member defines an opening so that the first support member is slidably movable along a longitudinal axis of the barrel and is removable from the firearm without having to remove the barrel nut;

a second support member removably coupled to a second mounting surface at a distal end from the first support member, wherein the second support member defines an opening so that the second support member is slidably movable about the longitudinal axis of the barrel and is removably coupled to the firearm without having remove the barrel nut; and a hand guard at least partially surrounding the barrel and removably coupled to the first support at a first end of the hand guard and to the second support at a second end of the hand guard, wherein the first and second support members couple the hand guard to the firearm, and wherein the first support member operates between a first position, in which the first support member fixably supports the first end of the hand guard to the firearm, and a second position, in which the first support member releases the first end of the hand guard from the firearm.

9. A firearm as described in claim 8, wherein the first support member comprises a sleeve, a coupling element, and a biasing element disposed between a shoulder formed on an inner surface of the sleeve and a flange of the coupling element, wherein the biasing element provides an axial force in a direction along an axis of the barrel to bias the sleeve away from the flange of the coupling element, and wherein the biasing element enables the sleeve to move between the first and second positions.

10. A firearm as described in claim 9, wherein the biasing element comprises a plurality of springs coupled to the flange.

11. A firearm as described in claim 9, wherein the inner surface of the sleeve defines a recess to allow an operating element to pass therethrough.

12. A firearm as described in claim 9, wherein the sleeve includes a groove to receive a snap ring, wherein the snap ring operatively couples the sleeve to the coupling element.

13. A firearm as described in claim 9, wherein the first support member further comprises a holding collar adjacent the shoulder and the biasing element that engages the first end of the shell to secure the shell to the firearm.

14. A firearm as described in claim 9, wherein the coupling member comprises a clasp-like structure having a plurality of sleeve portions that form an opening, wherein the opening is sized so that the coupling element slidably moves about the barrel of the firearm, and wherein the plurality of sleeve portions frictionally engage the first mounting surface.

15. A firearm as described in claim 14, wherein the coupling member defines a gap to allow an operating element to pass therethrough and enables the coupling member to be radially coupled to the first mounting surface.

16. A firearm as described in claim 14, wherein the coupling member includes a plurality of recess portions to enable the coupling member to radially flex when the coupling member is coupled or removed from the first mounting surface.

17. A firearm as described in claim 8, wherein the second support member comprises a ring member having an opening so that the second support member is slidably movable along the barrel and a gap to allow passage of an operating element or sighting device therethrough, and wherein the gap enables the second support member to be radially coupled to the second mounting surface.

18. A firearm as described in claim 17, wherein the second support member includes a recessed portion that engages a protruding member of the operating element or sighting device.

19. A firearm as described in claim 8, wherein the first mounting surface comprises at least one of an outer surface of the barrel, a barrel nut, or the housing.

20. A firearm as described in claim 8, wherein the barrel includes at least one of a gas bleed port or a sighting device.

21. A holding unit system for coupling a hand guard shell to a firearm, comprising:

a first holding unit assembly to be coupled to a barrel nut of a firearm comprising:

a coupling element having an inner surface and an outer surface, the inner surface defines an opening that is sized to contact an outer surface of a barrel nut, wherein the inner surface includes a plurality of recess portions to enable the coupling element to radially flex, and wherein the outer surface defines a flange portion of the coupling element, wherein the flange portion defines a gap to allow a gas tube to pass therethrough and enables the coupling element to be radially coupled to the barrel nut;

a tubular sleeve operatively coupled to the coupling element having an opening to slidably move along the barrel and an inner surface forming a shoulder and a groove distally located from the shoulder;

a biasing element disposed between the flange of the coupling element and the shoulder of the sleeve to bias the sleeve away from the flange along a longitudinal axis of a barrel; and a snap ring received by the groove of the sleeve portion to retain the sleeve portion to the coupling element; and a second holding unit to be coupled to the barrel distally located from the first holding unit comprising a ring member having an opening so that the second holding unit slidably moves along the barrel and a gap to allow passage of a gas bleed port or sighting device therethrough, wherein the gap enables the second holding unit to be radially coupled to the barrel, and wherein the ring member includes a first recessed portion that receives a spring, wherein the spring engages a corresponding groove of the hand guard shell to hold the shell in a defined position.

22. A holding unit system as defined in claim 21, wherein the second holding unit further comprises a second recessed groove that engages a protruding member of a gas bleed port when coupled to the firearm to axially align the second holding unit with the barrel of the firearm.

* * * * *